United States Patent [19]

Sommers et al.

[11] 4,102,264

[45] Jul. 25, 1978

[54] NUMBERING THROW-OFF FOR COLLATOR

[75] Inventors: Richard L. Sommers; Fred H. Sickler, both of Emporia, Kans.

[73] Assignee: Didde-Glaser, Inc., Emporia, Kans.

[21] Appl. No.: 753,528

[22] Filed: Dec. 22, 1976

[51] Int. Cl.[2] ..... B41L 45/00

[52] U.S. Cl. ..... 101/77; 101/88

[58] Field of Search ..... 101/72, 76, 77, 78, 101/79, 80, 81, 82, 87, 88, 247, 218

[56] References Cited

U.S. PATENT DOCUMENTS

| | | | |
|---|---|---|---|
| 2,652,772 | 9/1953 | Katz | 101/72 |
| 2,839,991 | 6/1958 | Rothoff | 101/77 |
| 2,900,898 | 8/1959 | Buttner | 101/72 X |
| 3,603,251 | 9/1971 | Elsworth et al. | 101/76 |
| 3,815,495 | 6/1974 | Strackbein | 101/76 |
| 3,985,073 | 10/1976 | Keller | 101/247 X |

*Primary Examiner*—Edward M. Coven

*Attorney, Agent, or Firm*—Schmidt, Johnson, Hovey & Williams

[57] ABSTRACT

A low-cost, completely self-contained numbering unit for in-line web collators is provided which includes fully mechanical throw-off apparatus for selectively activating and deactivating the unit in a manner ensuring proper sequential numbering of forms or the like, notwithstanding intermittent temporary interruptions of web flow through the unit. The numbering unit hereof preferably includes a plurality of rotatable numbering machines each having an indexing arm, a pivotal cam engageable with the respective arms and shiftable between indexing and non-indexing positions, and control means for allowing such cam shifting only under circumstances ensuring maintenance of proper numbered sequence between forms or the like as they are produced. The control means preferably includes a rotatable, recessed control cam coupled to the numbering machine mounting shaft, along with a cooperating projection extending from a shiftable plate coupled to the indexing cam shaft; movement of the plate in a manner to pivot the indexing cam between the indexing and non-indexing positions thereof is thus precluded unless the control cam is rotated to a position permitting clearance of the plate projection therepast. The indexing cam is thus movable only when the numbering machines of the unit are in respective preset rotational position so that misnumbering of the forms is prevented. The plate is operated by means of a manual control knob, and is provided with biasing springs and limit means for facilitating smooth, measured movement thereof so that the indexing cam can be quickly and accurately shifted.

9 Claims, 7 Drawing Figures

Fig.1.
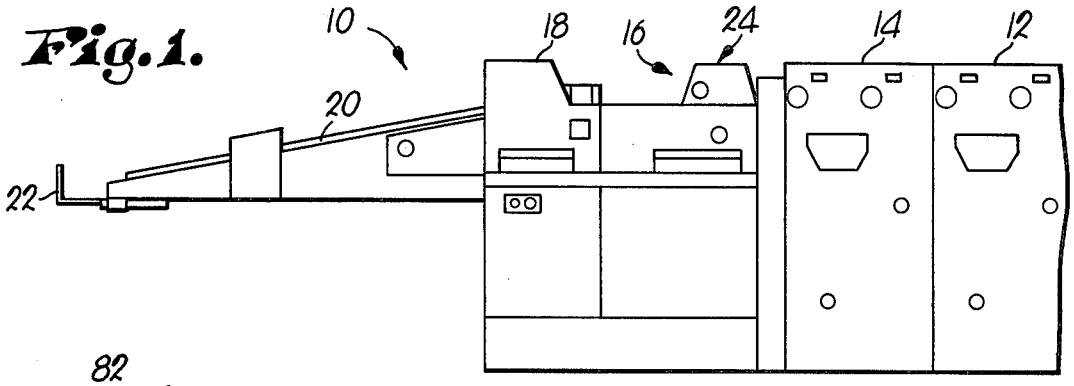
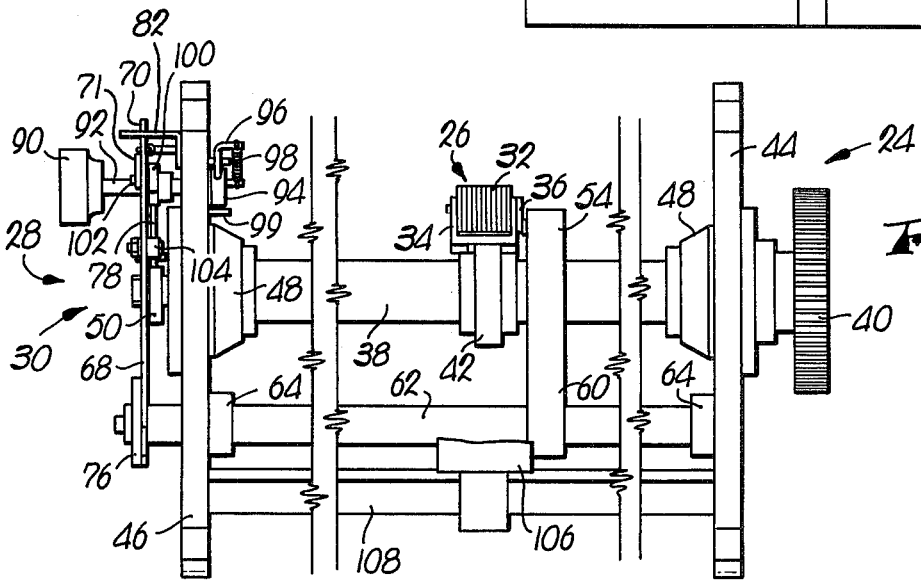
Fig.2.
Fig.3.
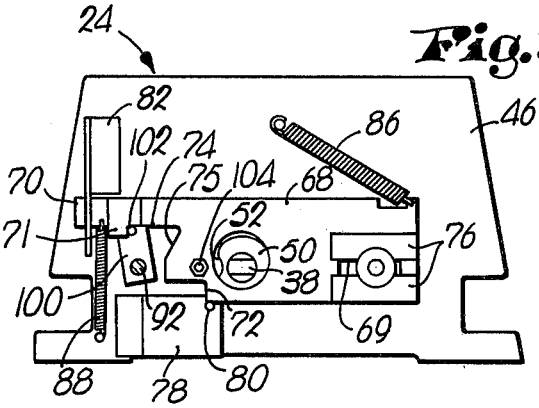
Fig.5.
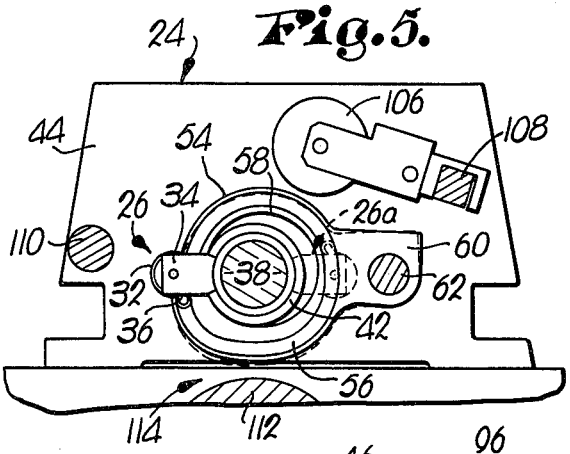
Fig.4.
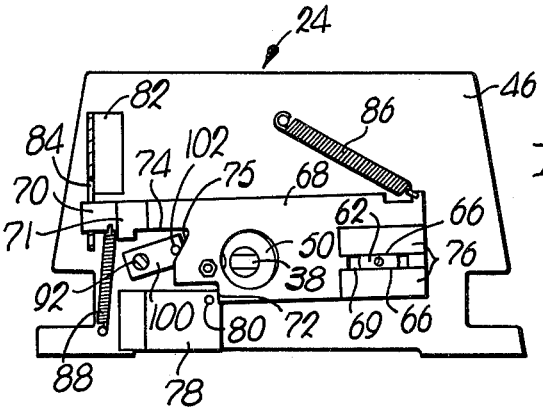
Fig.6.
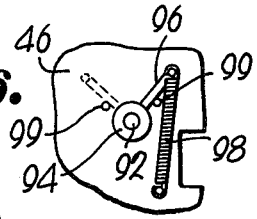
Fig.7.
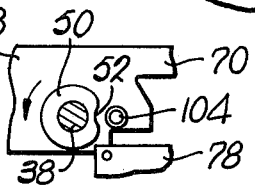

NUMBERING THROW-OFF FOR COLLATOR

This invention relates to a numbering unit adapted to be mounted on an in-line, web-fed collator for numbering forms or the like produced by the collator in a predetermined sequence. More particularly, it is concerned with a fully mechanized, self-contained numbering unit having controlled throw-off apparatus for selectively activating and deactivating the numbering unit only under circumstances ensuring maintenance of the numbered sequence of the forms notwithstanding temporary interruptions in web flow.

In the production of business forms and the like, it is common to provide so-called in-line web collators which are capable of marrying a plurality of preprinted webs, gluing the webs along one marginal edge thereof, and cutting the glued webs into forms of predetermined size. In addition, it is often desired that such forms be sequentially numbered for bookkeeping or other purposes. Accordingly, a variety of numbering units have been proposed in the past for use in conjunction with web collators.

For example, one such numbering unit in widespread use today includes a rotatable numbering machine which can be indexed during rotation thereof to sequentially change the number applied to the successively produced business forms. The machine includes an indexing arm received within the groove of a shiftable indexing cam, with the latter being selectively movable between machine indexing and non-indexing positions. In this fashion, machine indexing can be terminated as desired, when, for example, web flow through the unit is temporarily interrupted. It will be appreciated that this so-called "throw-off" function of the numbering unit is important for maintaining the proper numbered sequence of business forms or the like. Without the ability to temporarily discontinue indexing of the numbering machine, any waste forms produced (as when webs must be spliced or the like) would bear a number which should belong in the sequence of the finished, salable forms. Thus, in order to operate efficiently, a throw-off function in the numbering unit is extremely desirable.

Conventional numbering units are oftentimes provided with electrically controlled means for shifting the indexing cam between the indexing and non-indexing positions thereof. Specifically, a selectively operable solenoid valve assembly coupled to a pneumatic cylinder is sometimes used for shifting of the indexing cam in a manner to ensure proper coordination between the numbers applied to successive forms when web flow is interrupted. Although effective for quickly and accurately shifting of the cam between the operative positions thereof, this type of mechanism has a number of drawbacks.

The prime objection is that although electrically controlled numbering units do provide a coordinated throw-off function for preventing misnumbering of forms, they are relatively complex in construction and difficult to install and replace. Furthermore, these units are of necessity expensive because of the electrical or electrical-pneumatic controls provided.

It is therefore the most important object of the present invention to provide a self-contained, fully mechanical numbering unit which completely eliminates the need for electronic control circuitry, and which includes reliable, controlled throw-off apparatus which ensures that the numbered sequence between finished forms is maintained even in the event that web flow through the unit is temporarily interrupted, so that waste is reduced and operator time minimized.

Another object of the invention is to provide a numbering unit of the type described which includes at least one and more preferably two or more rotatable numbering machines each having an indexing arm, a pivotal cam engageable with the respective arms and shiftable between indexing and non-indexing positions, and control means for allowing shifting of the indexing cam only in a manner which ensures the proper sequential numbering of business forms or the like being produced; the control means preferably includes a recessed, rotatable control cam coupled to the numbering machine mounting shaft, along with a cooperating projection extending from a shiftable operating plate rotationally coupled with the indexing cam, so that movement of the operating plate (and thus the indexing cam) is precluded unless the control cam is in a preset rotational position permitting clearance of the plate projection.

Another aim of the invention is to provide throw-off apparatus for the indexing cam of a numbering unit to shift the indexing cam between the operative positions thereof and including an operational plate shiftable relative to the pivotal mounting shaft of the indexing cam but rotationally locked therewith, manually operable knob means for pivoting and shifting the plate between the respective positions thereof for correspondingly shifting the indexing cam, and stop means for limiting the movement of the plate so that smooth, accurate shifting of the indexing cam is assured. The throw-off apparatus is thus completely mechanical with all electronic control circuitry and the like being eliminated, so that the cost and complexity of the throw-off apparatus is materially lessened.

In the drawing:

FIG. 1 is a fragmentary side elevational view of an in-line, multiple-station web collating apparatus used in the production of business forms and having the numbering unit of the present invention mounted thereon;

FIG. 2 is a fragmentary plan view with parts broken away for clarity of the numbering unit in accordance with the present invention;

FIG. 3 is a side elevational view with parts broken away for clarity illustrating the throw-off apparatus of the numbering unit as it would appear when the indexing cam is shifted to the non-indexing position;

FIG. 4 is a side elevational view similar to that of FIG. 3 and illustrates the throw-off apparatus when the indexing cam is shifted to the indexing position thereof;

FIG. 5 is a fragmentary vertical sectional view of the numbering unit and illustrates a pair of numbering machines having the indexing arms thereof received within the groove of the indexing cam, with the latter having its non-indexing position shown in bold lines and its indexing position shown in phantom;

FIG. 6 is a fragmentary side elevational view illustrating the position of the control knob shaft at the respective positions thereof when the indexing cam is in its non-indexing and indexing positions; and FIG. 7 is a fragmentary view in vertical section illustrating the relationship between the recessed control cam and plate projection of the throw-off apparatus, viewing from the opposite side of the plate illustrated in FIGS. 3 and 4.

Referring first to FIG. 1, an in-line, multiple-station collating apparatus 10 is illustrated which includes a number of separate web-handling stations such as marrying and gluing stations 12 and 14, numbering and counting station 16, and cutting station 18. In addition, a delivery conveyor 20 is provided for receiving the output of cut business forms or the like from station 18, and collecting the latter in hopper 22. As briefly explained above, collating apparatus 10 is operable to marry, glue, number and cut a plurality of preprinted webs to form, at high speeds, multiple-page business forms or similar items.

Numbering and counting station 16 includes a removable, completely self-contained and fully mechanized numbering unit 24. Referring to the remaining Figures it will be seen that unit 24 broadly includes at least one shiftable numbering machine 26 which is operable for successively numbering in a predetermined sequence forms or the like passing through apparatus 10, along with indexing means broadly referred to by the numeral 28 for causing machine 26 to be successively indexed or altered so that the number applied by numbering machine 26 is changed for each form passing through unit 24. In this regard, indexing means 28 also preferably includes control means 30 which allows actuation and deactuation of indexing means 28 only in a manner for ensuring proper sequential numbering of the webs passing through unit 24 in accordance with the predetermined numbering sequence. Although the ensuing discussion will for purposes of simplicity and clarity be directed to a numbering unit which includes only a single numbering machine 26, it is to be understood that the invention is not so limited. As shown for example in FIG. 5, a second numbering machine **26*a*** could be added, and in fact three or more such machines may be used. The advantages of the present invention are perhaps most pronounced when multiple numbering machines are employed, because of the greater difficulty of maintaining proper numbering coordination in such cases.

In more detail, numbering machine 26 is preferably of conventional construction and includes a plurality of side-by-side, shiftable, numeral-bearing elements 32 which are mounted within a frame 34. A shiftable indexing arm 36 extends from frame 34 and is operable in the known manner to successively alter the relative position of the respective elements 32 for changing the number printed by machine 26 during rotation thereof.

Numbering machine 26 is supported on an elongated, cylindrical shaft 38 which extends transversely through unit 24 and has a drive gear 40 journaled to the right-hand end thereof as viewed in FIG. 2. A machine mounting collar 42 is secured to shaft 38 and provides a base for the respective numbering machines 26. As noted, a plurality of separate numbering machines 26 could be provided about the circumference of collar 42. An example of this alternative is depicted in FIG. 5 wherein a 17in. collator is used to fabricate business forms having an 8½-in. width. In such a situation, the cutting head of the collator would cut the preprinted 8½-in. images into forms, and accordingly numbering of each of these forms would be required. Thus, in the example given above, two separate, equidistantly spaced numbering machines 26 would be secured to collar 42. Of course, other combinations and form sizes could also be produced on 17-in. and other types of web collators, and in these cases the position and number of machines 26 would be adjusted accordingly.

Numbering unit 24 also includes upstanding sidewalls 44 and 46 which, in cooperation with conventional bearing structures 48, support shaft 38 at the opposed ends thereof. As explained, drive gear 40 is journaled to shaft 38 adjacent wall 44, while a control cam 50 is secured to the opposite end of shaft 38 adjacent wall 46 and exteriorly of the latter. Control cam 50 is configured to present a recess 52 along the periphery thereof which is important for purposes to be made clear hereinafter.

Indexing means 28 includes a cam 54 having an irregular, continuous cam groove 56 therein which receives the outermost end of indexing arm 36 (see FIGS. 2 and 5). Cam 54 is apertured as at 58 in the central area thereof for accommodating rotation of shaft 38, and also includes a radially extending mounting portion 60. A rotatable cam shaft 62 extends through portion 60 and is fixedly secured to cam 54 so that rotation or pivoting of shaft 62 correspondingly pivots cam 54. Shaft 62 is supported adjacent the respective ends thereof by means of bearings 64 provided on sidewalls 44 and 46. In addition, the left-hand end of shaft 62 as viewed in FIG. 2 extends through an appropriate aperture in wall 46, and the extended portion thereof is milled to present planar, substantially parallel surfaces 66 (see FIG. 4).

Indexing means 28 also includes an irregularly-shaped, pivotal and shiftable operating plate 68 which is complementally slotted as at 69 adjacent one end thereof to receive the milled surfaces 66 of shaft 62, and includes an elongated tongue portion 70 at the opposite end thereof having a depending lip 71. Plate 68 is also configured to present a pin-receiving recess defined by surface 72 and a second recessed area defined by the undersurface 74 of tongue portion 70 and adjacent oblique surface 75. Plate 68 is mounted for shiftable movement relative to shaft 62 but is rotationally locked therewith. In this connection, slot 69 of plate 68 receives the extended portion of shaft 62 bearing the milled surface 66. A pair of flat connection plates 76 are connected to the outermost face of plate 68 adjacent slot 69 for engaging the flattened surfaces 66 of shaft 62 so that plate 68 and the latter pivot in unison. In addition, slot 69 of plate 68 is configured relative to surfaces 66 for permitting back-and-forth shifting of plate 68 relative to shaft 62.

A secondary plate 78 is rigidly connected to sidewall 46 as best seen in FIGS. 3 and 4 and includes an outwardly extending stop pin 80. In addition, a motion-limiting bracket 82 having a slot 84 therein is also attached to sidewall 46, with the tongue portion 70 of plate 68 being received within slot 84. In addition, separate biasing springs 86 and 88 are connected between sidewall 46 and the adjacent ends of plate 68.

The operating means for unit 24 includes a rotatable knob member 90 having an elongated shaft 92 which extends through wall 46 and is attached to a cylindrical element 94. The latter has a radially extending arm 96 connected thereto, and a spring 98 is coupled between the interior surface of wall 46 and the outermost end of arm 96 (see FIG. 6). A pair of spaced stop elements 99 are also provided on wall 46 for limiting the rotation of arm 96. As best seen in FIG. 6, spring 98 and the elements 99 cooperatively serve to hold arm 96, and thereby member 90, at the respective operative positions thereof as will be described.

A radial block 100 is fixedly connected to rotatable shaft 92 adjacent the outermost face of wall 46 for rotation therewith. Block 100 includes an outwardly extending operating pin 102 which is operative for alternately engaging surfaces 74 and 75 during manipulation of knob member 90.

Control means 30 includes, in addition to recessed cam 50, an inwardly extending projection 104 strategically mounted on plate 68 between surfaces 72 and 75. Recess 52 of control cam 50, and projection 104, are cooperatively configured so that movement of plate 68 is possible only when the control cam assumes a rotational position where projection 104 can be partially received within recess 52 in order to clear cam member 50.

Unit 24 also includes a conventional inking roll 106 carried by cross shaft 108 which serves to successively ink the arrays of numbers presented by numbering machine 26. In addition, cross braces between sidewalls 44 and 46, such as shaft 110, can be provided as necessary for ensuring rigidity of the overall numbering unit.

In use, numbering unit 24 is mounted on numbering and counting station 16 in substantially aligned, adjacent relationship to a driven metallic impression cylinder 112 (see FIG. 5). Drive gear 40 attached to shaft 38 is operatively coupled to a corresponding gear (not shown) provided with cylinder 112 so that the latter and shaft 38 (and thereby numbering machine or machines carried thereby) are rotated in unison. During normal operations, a web of material passing through the nip area 114 presented between cylinder 112 and the rotating numbering machines will be numbered in accordance with the predetermined sequence set in the numbering machines.

Referring specifically to FIG. 4, the indexing position of apparatus 24 is illustrated. In this configuration, plate 68 is shifted so that stop pin 80 is proximal to surface 72, with spring 88 serving to bias tongue portion 70, and thus plate 68, downwardly. Furthermore, spring 98 coupled to knob member 90 through arm 96 serves to urge pin 102 against surface 75 to hold plate 68 in the indexing position. In this disposition, groove 56 of cam 54 receiving indexing arm 36 is located for successively shifting arm 36 during travel thereof around the cam groove for indexing machine 26 in accordance with a predetermined sequence. For example, in the specific embodiment illustrated wherein only a single machine 26 is used, it may be desired to consecutively number forms or the like produced by the collator; in this instance, machine 26 would be set to increase the number successively presented for printing by a single digit.

In any event, continued web flow through nip area 114, along with operation of machine 24 through the medium of drivegear 40, will continually rotate shaft 38 and thus numbering machine 26, and the latter will be successively indexed during each revolution thereof. When it is desired to temporarily interrupt numbering as would occur when it becomes necessary to splice a web or the like, it is only necessary to rotate knob member 90 in a counterclockwise direction so that operating pin 102 of block 100 is rotated towards the non-indexing position illustrated in FIG. 3. Such rotation causes pin 102 to engage surface 74, which in turn pivots plate 68 upwardly. Continued rotation of knob member 90 causes pin 102 to engage depending lip 71 of tongue portion 70 so that plate 68 is thereby shifted to the left as viewed in FIGS. 3 and 4 and rests atop pin 80. This shifting action is facilitated through the use of spring 86 connected to the right-hand end of plate 68. In the non-indexing position illustrated in FIG. 3, and in bold lines in FIG. 5, cam 54 is pivoted to a point where machine 26 is not indexed during continued rotation thereof. This is important since during many temporary interruptions in web flow, shaft 38 and the numbering machines carried thereby will continue their rotation. If it is again desired to recommence indexing of machine 26, it is only necessary to reverse the above procedure and turn knob member 90 in a clockwise position so that plate 68 (and thereby cam 54) reassumes its indexing position.

However, an important feature of the above invention resides in the fact that the shifting of plate 68 between the indexing and non-indexing positions thereof can occur only in a manner for ensuring proper sequential numbering of business forms or the like produced by collator 10. Specifically, as shaft 38 rotates, cam member 50 attached to the outermost end thereof adjacent plate 68 likewise rotates. If knob member 90 is turned in either direction in an attempt to pivot and shift plate 68, movement of the latter will only occur when recess 52 of cam member 50 is aligned with projection 104. Referring specifically to FIG. 7, the operative aligned relationship between recess 52 of control cam 50 and projection 104 is illustrated. This Figure depicts plate 68 in the non-indexing position thereof where the underside of the plate rests atop stop pin 80. In such a case, if knob member 90 were rotated in a clockwise direction in an attempt to move plate 68 to its indexing position, an interference would be presented between projection 104 and the majority of the outermost surface of control cam 50. This interference would continue until recess 52 reached the aligned position illustrated in FIG. 7, whereupon continued hand pressure through the medium of knob member 90 would permit shifting of plate 68 and downward pivoting thereof in the manner described. In essence, recess 52 is configured for permitting projection 104, and thereby plate 68, to clear control cam 50; and such clearance is precluded when control cam 50 is in a movement-blocking position wherein recess 52 is not aligned with projection 104. Similarly, when it is desired to shift plate 68 from the indexing to the non-indexing positions thereof, control cam 50 and projection 104 operate in an identical manner to permit such shifting only when recess 52 and projection 104 are properly aligned.

The importance of control means 30 stems from the desirability of ensuring proper numerical sequence (in accordance with the predetermined numbering scheme) between forms produced by collator 10, even in the event of a temporary interruption in web flow through numbering unit 24. As will be clear from the foregoing, shifting of plate 68 and thereby cam member 54 can occur only when the one or more numbering machines are in a predetermined preset rotational position so that exact synchronization and successive numbering are automatically maintained between separate batches of forms or the like produced as a result of interruption in web flow. It is also noteworthy in this respect that such synchronization and sequence maintenance is achieved without any particular care or vigilance on the part of the operator, since indexing cam 54 can be pivoted between its operative positions only when machine 26 reaches a predetermined and fixed rotational position with respect thereto. This is to be contrasted with conventional shifting devices used in prior numbering units which require time-consuming operator control. Moreover, the unit hereof is completely mechanical in construction and operation and eliminates the need for costly electrical or electrical-pneumatic throw-off control apparatus.

Having thus described the invention, what is claimed as new and desired to be secured by Letters Patent is:

1. A numbering unit for successively numbering webs or the like in a predetermined sequence, said apparatus comprising:

at least one rotatable numbering machine mounted on a rotatable shaft and having a movable indexing arm for successively changing the number applied to said webs or the like during rotation of said machine and in accordance with said predetermined sequence;

a cam member having a groove therein for receiving said arm;

a pivotal shaft supporting said cam member and permitting shifting of the cam member between a first indexing position where said arm is successively moved for indexing said machine as the machine rotates and said arm travels within said groove, and a second position where said machine is not indexed during rotation thereof with said arm traveling within said groove; and means for pivoting said pivotal shaft for shifting said cam member between said first and second positions, said pivoting means including a plate coupled to said cam-supporting shaft and shiftable between respective positions corresponding to the first and second positions of said cam member;

operating means for pivoting said plate between said respective positions thereof for shifting of said cam member between said first and second positions.

2. The numbering unit as set forth in claim 1 including control means for allowing the pivoting of said plate only in a manner for ensuring proper sequential numbering of said webs or the like.

3. The numbering unit as set forth in claim 2 wherein said control means comprises:

a control cam mounted on said rotatable numbering machine shaft adjacent said plate and having a recess therein; and a projection carried by said plate, said projection and shift-controlling cam being cooperatively configured for permitting said pivoting and shifting of said plate only when said control cam is rotated to a position for allowing said projection to clear the control cam by passing through the recess thereof.

4. The numbering unit as set forth in claim 1 including manually rotatable knob means for pivoting and shifting of said plate between said respective positions thereof.

5. The numbering unit as set forth in claim 1 including biasing means for urging said plate into said respective positions as the plate is pivoted and shifted towards each of the respective positions.

6. The numbering unit as set forth in claim 1 including stop means comprising a pin, said plate being configured for resting atop said pin in one of said respective positions thereof, said plate also presenting a recessed area for receiving said pin when said plate is pivoted and shifted to the other of said respective positions.

7. A web numbering unit for successively applying numbers to a moving web and wherein application of successive numbers to the web may be selectively interrupted without loss of the numbering sequence while web movement continues or is intermittently carried out, said unit comprising:

at least one numbering machine movable through a path of travel to apply a number to the moving web and provided with an indexing arm shiftable from a first inactive location to a second active location effecting change of the numbering machine to another predetermined successive number;

indexing means including structure operably engageable with the indexing arm of the numbering machine which in an indexing position of the structure operates to shift said indexing arm from an inactive location thereof a sufficient distance toward an active location of the same to effect a numbering change of the numbering machine during each movement of the latter through a cycle to apply a number to said web;

shift-control means for said indexing means provided with a control plate which in the operating disposition thereof holds the structure in said indexing position of the same to effect numbering change of the numbering machine, said control plate being selectively movable to a standby disposition holding the structure in a second non-indexing position where such structure is incapable of shifting the indexing arm a sufficient distance to effect change of the numbering machine to the next successive predetermined number; and blocking means operably associated with said shift-control means for preventing return movement of the control plate from said standby disposition thereof until the numbering machine has reached a predetermined point in its cyclic path of travel for applying a number to said web.

8. The numbering unit as set forth in claim 7 wherein said numbering machine is mounted on a rotatable shaft for rotation therewith and said structure comprises a cam member mounted on a pivotal shaft and having a cam groove therein for receiving said indexing arm during rotation of said numbering machine.

9. The numbering unit as set forth in claim 7 wherein is provided manually manipulable means operably coupled to said control plate for moving the latter to and from the operating and standby dispositions thereof.

* * * * *